US005297933A

United States Patent [19]

Morgan

[11] Patent Number: 5,297,933

[45] Date of Patent: * Mar. 29, 1994

[54] CANTILEVER PADDLEWHEEL APPARATUS

[76] Inventor: Bruce S. Morgan, Embassy Park, 3188 Lake Shore Dr., Pembroke Park, Fla. 33009

[ * ] Notice: The portion of the term of this patent subsequent to Jan. 21, 2009 has been disclaimed.

[21] Appl. No.: 991,278

[22] Filed: Dec. 16, 1992

Related U.S. Application Data

[63] Continuation-in-part of Ser. No. 549,952, Jul. 19, 1990, Pat. No. 5,082,423, and a continuation-in-part of Ser. No. 737,336, Jul. 29, 1991, Pat. No. 5,195,872.

[51] Int. Cl.[5] ..... B63H 1/10

[52] U.S. Cl. ..... 416/111; 416/131; 415/141; 475/331

[58] Field of Search ..... 416/110, 111, 131, 160, 416/211; 415/141; 440/90, 91, 92, 93, 94; 475/305, 331, 346

[56] References Cited

U.S. PATENT DOCUMENTS

| | | | |
|---|---|---|---|
| 526,533 | 9/1894 | Knapp | 416/111 |
| 583,171 | 5/1897 | Curry . | |
| 957,099 | 5/1910 | Robinson . | |
| 1,540,257 | 6/1925 | Doehlert, Jr. . | |
| 1,636,423 | 7/1927 | Langenbach . | |
| 1,708,475 | 4/1929 | Krodel . | |
| 1,811,031 | 6/1931 | Smith et al. . | |
| 2,036,727 | 4/1936 | Stow . | |
| 2,258,699 | 10/1941 | Calvo-MacKenna . | |
| 3,027,863 | 4/1962 | Town . | |
| 3,131,772 | 5/1964 | Town . | |
| 3,915,586 | 10/1975 | Gassie . | |

FOREIGN PATENT DOCUMENTS

| | | | |
|---|---|---|---|
| 26485 | 6/1906 | Fed. Rep. of Germany . | |
| 807599 | 7/1951 | Fed. Rep. of Germany | 416/111 |
| 347083 | 3/1937 | Italy | 416/111 |

*Primary Examiner*—Edward K. Look
*Assistant Examiner*—James A. Larson
*Attorney, Agent, or Firm*—Oltman and Flynn

[57] ABSTRACT

This invention is a paddlewheel apparatus having an epicyclic gear train in a rotatable holder at an end of a plurality of cantilevered paddles. The paddles are maintained substantially vertical throughout the rotation of the holder and they are completely unobstructed by any other part of the apparatus in all phases of operation. A housing which extends over the holder and the paddles is open at the bottom to pass the downwardly hanging paddles into the water.

16 Claims, 4 Drawing Sheets

CANTILEVER PADDLEWHEEL APPARATUS

CROSS-REFERENCE TO RELATED APPLICATIONS

This application is a continuation-in-part of application Ser. No. 07/549,952, filed on Jul. 9, 1990, U.S. Pat No. 5,082,423, and of application Ser. No. 07/737,336, filed on Jul. 29, 1991, U.S. Pat. No. 5,195,872.

SUMMARY OF INVENTION

The present invention relates to a paddlewheel apparatus of the type in which the paddles are maintained substantially at a predetermined angle, preferably vertical, throughout the rotation of the paddlewheel.

A principal object of this invention is to provide such a paddlewheel apparatus in which the paddles are completely unobstructed in all rotational positions by any other part of the apparatus, thereby enabling the use of paddles which are longer vertically and can dip farther into the water.

Further objects and advantages of this invention will be apparent from the following detailed description of the presently preferred embodiment which is illustrated schematically in the accompanying drawings.

Preferably, the paddlewheel apparatus according to this invention has a fixed, coaxial, rotatable sun gear at one of its ends, the sun gear being part of an epicyclic gear train having idler gears engaged between the sun gear and respective planet gears. The epicyclic gear train is in a holder which is rotatable on the axis of the sun gear and rotatably supports the idler and planet gears of the gear train. Each paddle is coupled at one end to a corresponding planet gear of the epicyclic gear train. Beside the rotatable holder, the paddles are completely unobstructed by any other part of the paddlewheel apparatus in all rotational positions. The gear train maintains the paddles substantially vertical throughout each rotation of the holder.

The paddles are preferably free to pivot in the direction of fluid flow to prevent drag. Each paddle is mounted at one end on axle means, which may take the form of a hollow shaft of which the opposite end extends into a planet gear. The hollow shaft is preferably free to pivot within a supporting bushing. The bushing separates the planet gear and shaft, and has broken sections which creates radial slots between the bushing and shaft. The shaft preferably has radial opposing ribs which extend from the shaft into the slots. The ribs and slots permit the paddle to pivot freely in one direction but hold the paddle against pivoting in the other direction. This permits the paddle to drive against the fluid in one direction and pivot to prevent drag in the other. A lever may be provided for the sun gear to reorient the planet gears for reverse operation. For this embodiment the sun gear is rotated by the lever.

Before explaining the disclosed embodiments of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

First Preferred Embodiment

Figure 1:
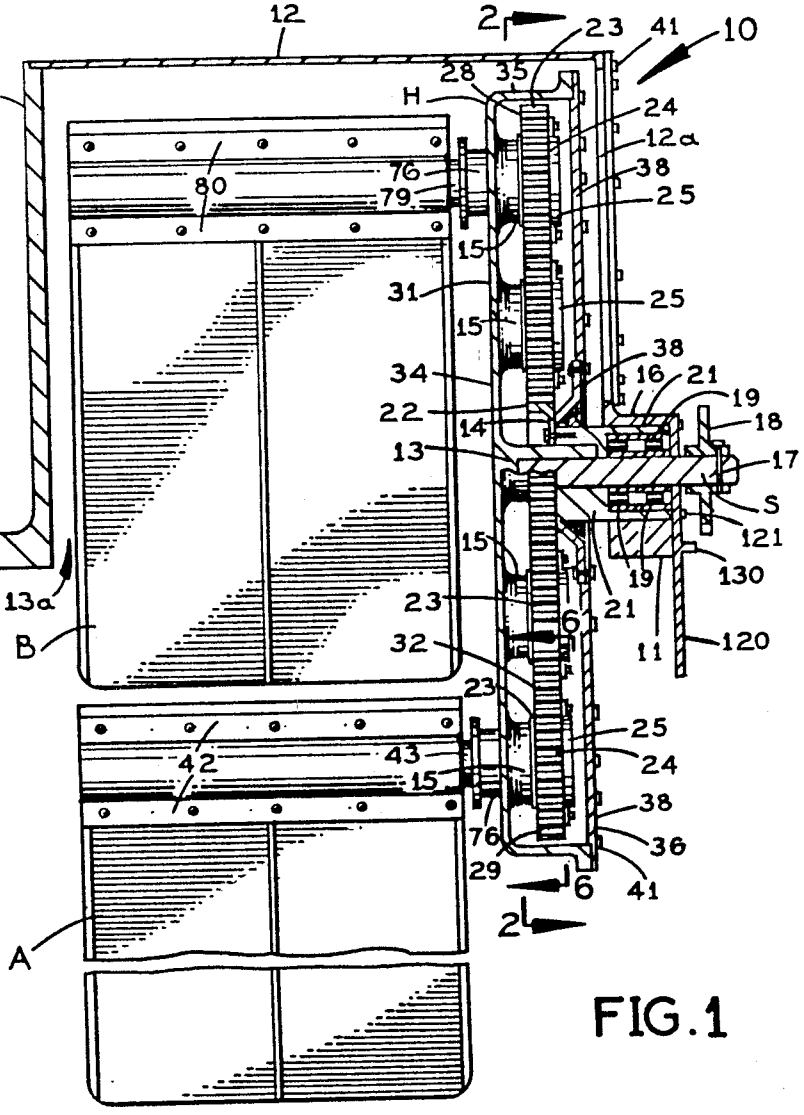
FIG. 1 is a longitudinal vertical sectional view of the preferred embodiment.

Referring to FIG. 1, the present paddlewheel apparatus 10 has a generally inverted U-shaped housing 12 including flat opposite end walls 12*a* and 12*b* and a rectangular opening 13*a* along the bottom. Gear 18, which is a drive member in apparatus 10, engages a flexible endless drive chain (not shown) of conventional design. An electromotive force (EMF) device (not shown), which may be either an electric motor or an electric generator, is mounted outside housing 12 close to end wall 12*a*. The EMF device has a rotatable shaft carrying a gear which also engages the drive chain.

A support 11 supports apparatus 10. Gear 18 encircles a segment of a rotatable central shaft S and is affixed thereto by a pin 17. Shaft S extends into housing 12 through a rotatable hub 21 of cylindrical cross-section which is rotatably mounted in a tubular flange 66 formed in wall 12*a* and extending through support 11. Therefore gear 18 can rotate shaft S within hub 21 and the axis of shaft S and hub 21 coincide with the axis of rotation of gear 18. Shaft S rides on two roller bearings 19 within hub 21. Shaft S extends inwardly through the center of sun gear 22 and beyond to end wall 34 of holder H at which point it is rigidly attached to holder H, thereby causing holder H to revolve in unison with shaft S. Shaft S preferably expands where it attaches to end wall 34 to form a mounting hub 13.

Laterally inward from bearings 19, a rotatable, central sun gear 22 is rigidly mounted on the end of the rotatable hub 21, within the gear holder H. Sun gear 22 is part of an epicyclic gear train of generally known design. Specific design characteristics, however, make sun gear 22 capable of compact mounting and readily replaceable when worn. Sun gear 22 is formed of a ring member 23 having gear teeth on its outer circumferential edge 24 and an inward extending mounting flange 14. See FIG. 1. Sun gear 22 is preferably split into two separate half portions, so that gear 22 can be removed from around shaft S without disassembly of the hub 21 and bearing 19 structure. Sun gear 22 is mounted on the interior end of rotatable hub 21, with bolts extending through flange 14.

Extending radially outward from sun gear 22 is the remainder of the epicyclic gear train. Two planet gears 28 and 29 (FIGS. 1 and 2) are arranged at equal intervals circumferentially around sun gear 22 and are coupled to sun gear 22 by respective idler gears 31 and 32. Planet gears 28 and 29 have the same diameter, the same number of teeth, and the same compact structure of sun gear 22. Each includes a ring member 23 and a mounting flange 25, so that the corresponding bearing hub 15 is received within ring member 23. Flange 25 is the top portion of a tubular bushing 27 which is surrounded by roller bearings 19 contained within a bearing hub 15. Bearing hub 15 has an axial bore 20*a* for containing the roller bearings 19 and bushing 27.

Figure 2:
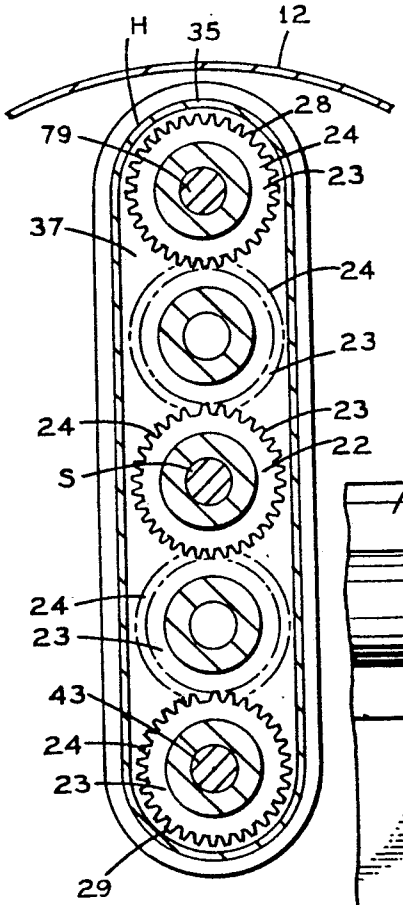
FIG. 2 is a cross-section along line 2—2 of FIG. 1 showing the epicyclic gear train within the holder.
Figures 11, 12:
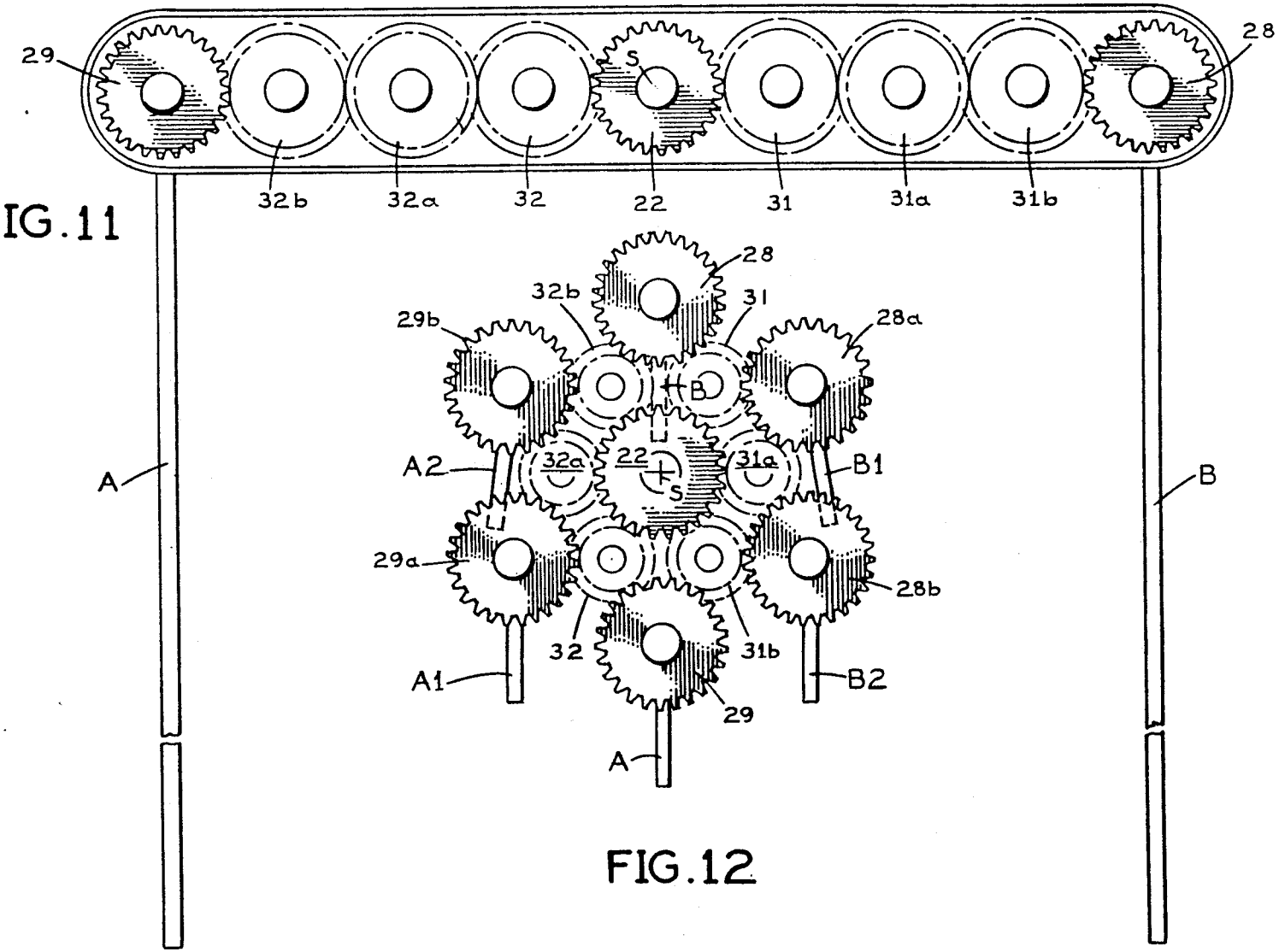
FIG. 11 shows an embodiment of the epicyclic gear train, elongated by the addition of four idler gears.
FIG. 12 shows an embodiment of the epicyclic gear train having six planet gears around the sun gear, each drivingly connected to the sun gear by two idler gears.

The bearing hubs 15 of planet gears 28 and 29 are preferably fitted with two roller bearings 19 for added strength to carry the load of paddle mounting shafts. Bearing hubs 15 of idler gears 31 and 32, however, are preferably fitted with a single roller bearing 19, because they do not contain mounting shafts and thus are not subjected to such significant lateral loads. Counter-sunk bores 20*b* are preferably provided for bearing hubs 15 of idler gears 31 and 32, and in this instance their purpose is simply to form a hollow to reduce weight and materials costs. FIGS. 1 and 2 show in detail how idler gear 32 is engaged between sun gear 22 and planet gear 29, meshing with both of them. FIG. 11 shows how the length of the gear train, and thus the reach of the paddles, can be extended by adding more idler gears 31*a* and 31*b* and 32*a* and 32*b*. FIG. 12 shows an arrangement where six planet gears 28–28*b* and 29–29*b* are provided, and each planet gear is drivingly connected to sun gear 22 by two idler gears 31–31*b* or 32–32*b*.

Figure 9:
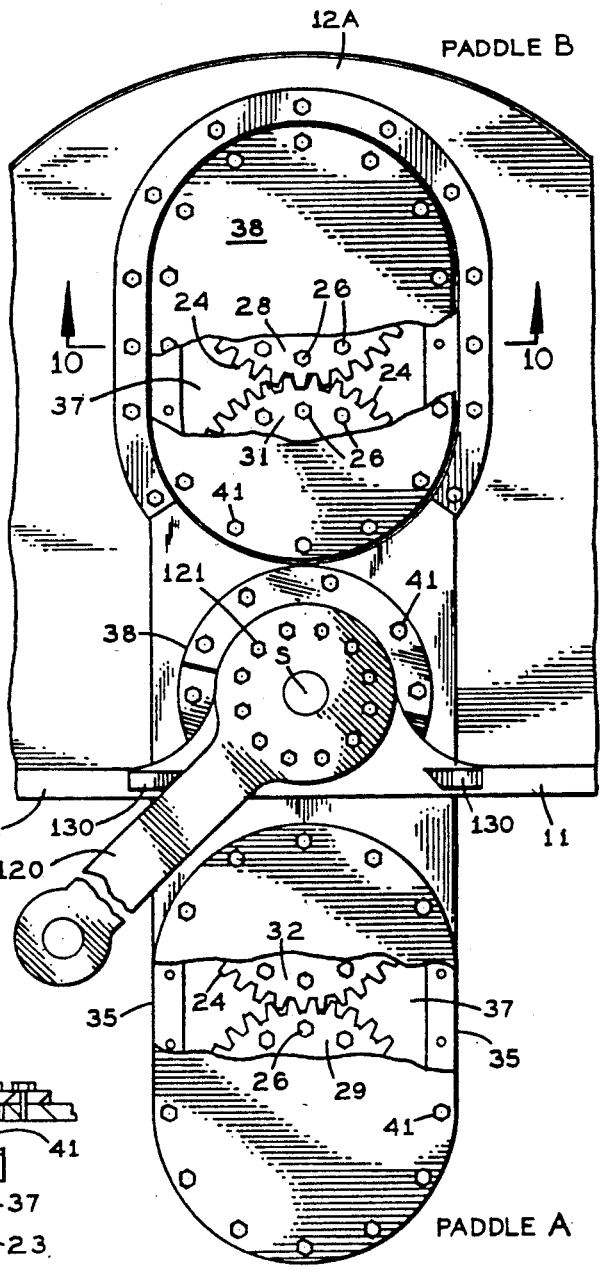
FIG. 9 is a side view of FIG. 1, showing access plates in the housing and the lever, with portions of the access plates cut-away to reveal the idler and plane gears.

As indicated above, a gear holder H contains sun gear 22, planet gears 28 and 29, and the idler gears 31 and 32, which are all rotatably mounted on bearings 19. Holder H is rectangularly-shaped and has a generally linear opening 37 in its outer end wall, as shown in FIG. 2. As shown in FIG. 1, holder H has flat, generally rectangular end walls 34 and 36 and a peripheral wall 35 joined integrally to these end walls 34 and 36 and extending perpendicularly between them. Bearing hubs 15 are each integrally joined to holder H end wall 34. Openings 37 are provided in end wall 36, and are closed with removable covers 38 which fit over them, and are positioned to provide access to planet gears 28 and 29 and idler gears 31 and 32. A circular cavity containing a water-tight seal encircles rotatable hub 21, and a cover 38 which is divided into two halves is removably fitted over this cavity, with bolts 41. See FIG. 9.

Figure 7:
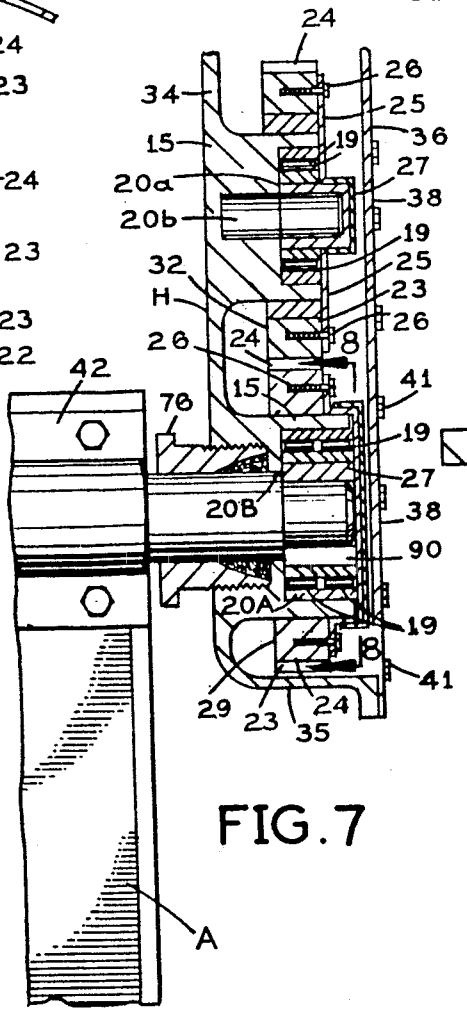
FIG. 7 is an enlarged fragmentary vertical section showing the lost-motion coupling between one paddle and the corresponding planet gear in the epicyclic gear train at one end.

Counter-sunk bores 20*b* in bearing hubs 15 of planet gears 28 and 29 each receive a tubular shaft, 43 and 79, respectively. See FIGS. 1 and 7. U-shaped brackets, 42 and 80, grippingly wrap around shafts 43 and 79, respectively, and each extends outward longitudinally of the paddlewheel apparatus 10. A paddle A is bolted to bracket 42 and a paddle B is bolted to bracket 80. Shafts 43 and 79 are thus rigidly attached to their respective paddles. Shafts 43 and 79 each pass through inner end wall 34 of holder H and are each encircled by a flanged bushing 76 screw-threadedly received in holder H. Seals engage shafts 43 and 79 in water-tight fashion at a recess in the flanged bushing 76 and inward beyond the inner end wall 34 of holder H. Flanged bushing 76 holds the seal compressed against the shafts 43 and 79 sufficiently to provide a water-tight seal around the shafts.

As shown in FIG. 1, paddles A and B extend lengthwise along brackets 80 and 42, respectively, a short distance in from holder H and then terminate, each forming a cantilever structure.

Each paddle A and B optionally has a plurality of stiffening ribs (not shown) at intervals along its length. Each of these optional stiffening ribs extends perpendicular to the supporting bracket 42 or 80 of the paddle and projects on opposite sides of the paddle.

An important feature of this invention is that there is no obstruction, such as an axle, below either of the two paddles A and B at any instant during each rotation of holder H. For this reason each paddle may have a vertical dimension below the axis of its planet gear 28 or 29 greater than the radial distance between the axis of the central gear 22 and the axis of the planet gear to which that paddle is connected. The greater this vertical dimension of the paddle, the farther the paddle can enter the water in its lowermost position (as shown for paddle B in FIG. 3) and therefore the greater the power transfer from paddle to water or vice versa.

OPERATION

In the operation of the paddlewheel apparatus 10, as described, if the EMF device is a motor, it will rotate gear 18 through the chain. Holder H rotates in unison with gear 18 and causes the planet gears 28 and 29 to revolve circumferentially around the sun gear 22 (which does not rotate with gear 18 and holder H). Through the gear-toothed coupling between planet gears 28 and 29 and sun gear 22 that is provided by idler gears 31 and 32, the planet gears turn within the rotating holder H such that they always maintain the respective paddles A and B hanging down vertically, subject to a possible 90 degree pivot described below.

Figure 3:
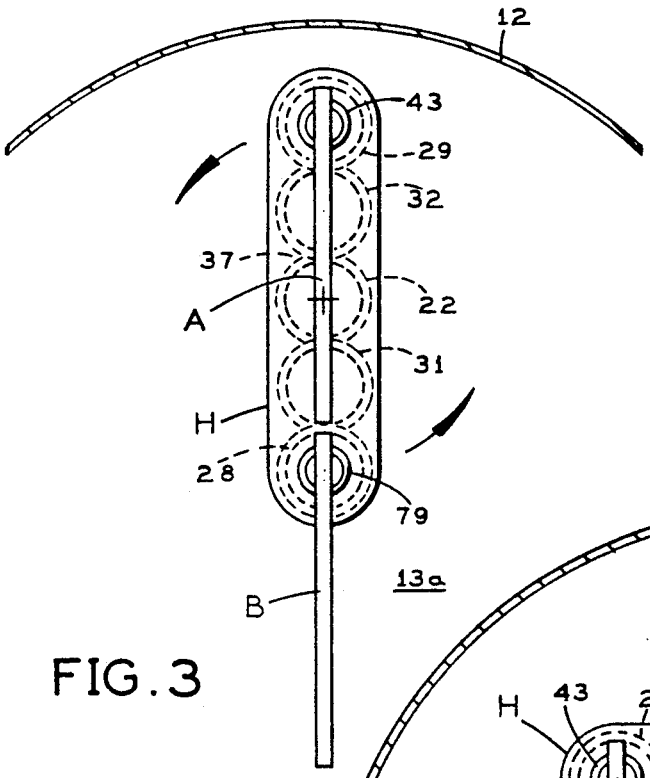
FIGS. 3, 4 and 5 are cross-sectional side views of the preferred embodiment showing the paddles in positions 45 degrees apart counterclockwise around the central axis of the paddlewheel apparatus.
Figure 6:
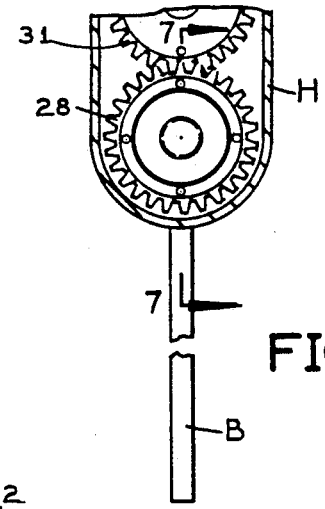
FIG. 6 is a fragmentary vertical section taken along line 6—6 in FIG. 1.
Figure 5:
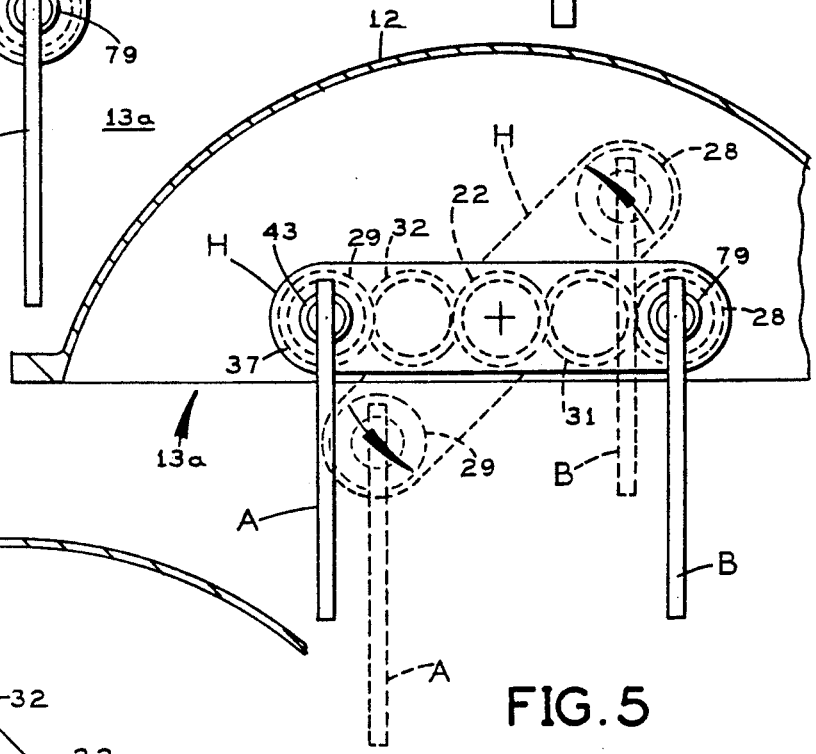
Figure 4:
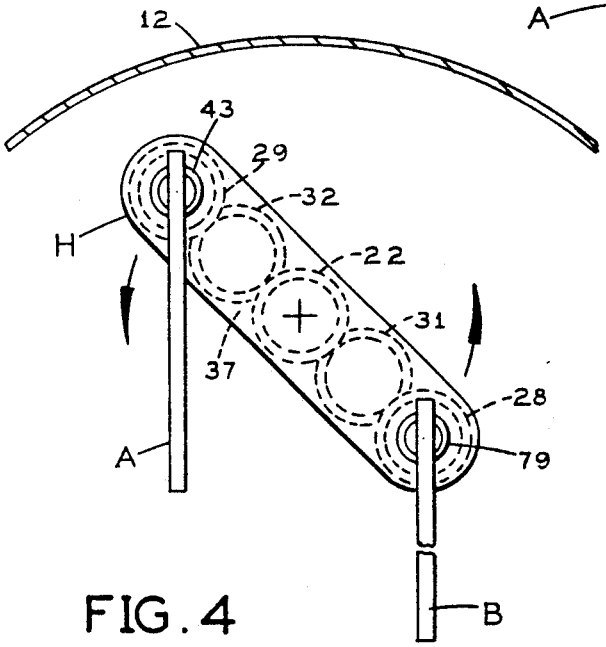

FIGS. 3, 4 and 5 show the positions of the parts at 45 degree intervals of counterclockwise rotation of holder H.

In FIG. 3 paddle B is in its lowermost position, hanging down through the bottom opening 13*a* in housing 12, vertically below the axis of shaft S (which is the rotational axis of holder H), and paddle A is on the opposite side from paddle B.

FIG. 4 shows the paddles 45 degrees counterclockwise from their positions in FIG. 3.

FIG. 5 shows the paddles 45 degrees counterclockwise from their FIG. 4 positions, and shows still another 45 degree rotation counterclockwise in broken lines. Now paddles A and B hang down through the bottom opening 13*a* in housing 12.

Essentially the same action takes place in reverse if the EMF device is a generator and the motive power for the paddlewheel apparatus 10 is from a fluid stream, such as water, in which case the relative movement between the water and the paddles causes the holder H to rotate.

Figure 8:
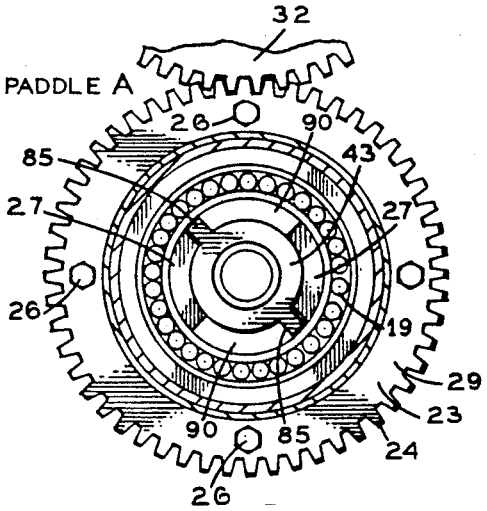
FIG. 8 is a diametric cross-sectional view of a planet gear, showing the same lost-motion coupling as in FIG. 7.

At its end away from paddle A, hollow shaft 43 has two opposing radial ribs 85. See FIG. 8. Shaft 43 is surrounded by bushing 27, which has two opposing arcuate slots 90 of greater arc length than ribs 85, which receive ribs 85 and permit ribs 85, and thus shaft 43, to rotate a predetermined number of degrees. Slots 90 are of substantially greater extent circumferentially of shaft 43 than the ribs 85 so as to provide a lost-motion coupling between paddle A and planet gear 29 when the paddle first encounters resistance. The ribs 85 may equivalently extend inward from the bushing 27 into slots 90 in shaft 43. For example, in the case of a motor-driven paddlewheel apparatus 10, when the paddle A first enters the water, this lost-motion coupling permits limited relative rotation between planet gear 29 and paddle A.

An identical lost-motion coupling is provided for the other paddle B and the corresponding planet gear 28 of the paddlewheel apparatus 10.

Figure 8A:
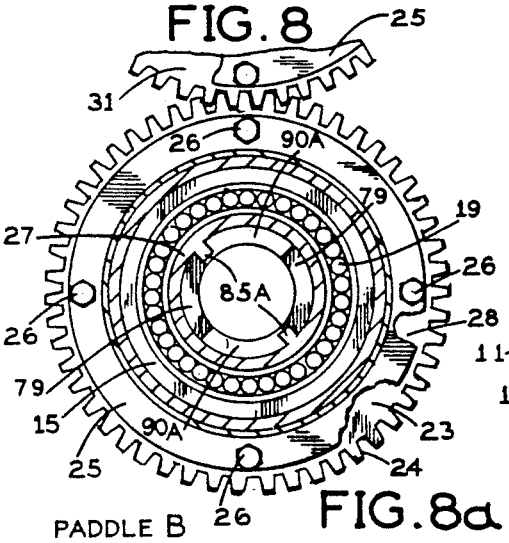
FIG. 8*a* is a diametric cross-sectional view of a planet gear, showing a second embodiment of the invention lost motion coupling.
Figure 10:
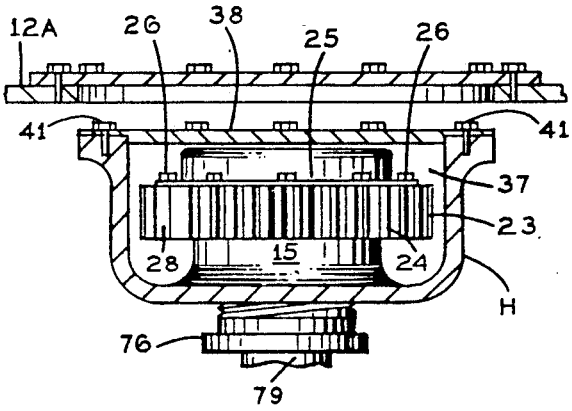
FIG. 10 is a cross-sectional view of the holder and a planet gear, taken along lines 10—10.

An alternative lost motion coupling is also provided. Bushing 27 has a bore with a cylindrical wall and two ribs 85*a* extending radially inward from the cylindrical wall toward shaft 79. See FIG. 8*a*. Shaft 79 has two opposing arcuate slots 90*a* of greater arcuate length than ribs 85*a*, which receive ribs 85*a* and permit ribs 85*a*, and thus shaft 79, to rotate the above-mentioned predetermined number of degrees. The lost motion function and structure are otherwise the same as described above.

Holder H has access openings, covered by covers 38, which are removable to allow access within the holder H for maintenance purposes. These holder H covers 38 also serve to limit the distance of the outward thrust of bushings 27, thereby maintaining proper position of the bearings 19 within their bearing enclosure and proper alignment of the rotating gears.

The paddles are preferably free to pivot in the direction of the fluid flow relative to the apparatus 10 to prevent drag. For purposes of illustration, it is assumed that the apparatus 10 propels a ship. In place of the EMF device, a steam or internal combustion engine may power the apparatus 10.

Since paddles A and B move about the circumference of a circle, their direction of movement, or velocity, continuously changes. At the instant the axis of the planet gear supporting a given paddle is contained within the horizontal plane containing the axis of the sun gear 22, the direction of the given paddle's velocity is vertical, either straight up or straight down. If moving straight down toward the water, the velocity of the paddle gradually develops a horizontal component in the direction of water flow relative to the apparatus 10. At the same time, the vertical component gradually diminishes. When the paddle is directly below the axis of the sun gear 22, the paddle velocity is entirely horizontal.

The changing horizontal component of paddle velocity creates a problem of drag over a portion of the rotational path. When the paddle initially touches the water surface, the horizontal component of paddle velocity is less than the horizontal component of the water velocity relative to the apparatus 10. Thus, since the water at this point is moving faster than the paddle, it drags against the paddle. As the paddle advances along its path, the horizontal component of the paddle velocity overtakes and surpasses the relative horizontal water velocity, and the engine drives the paddle against the water, propelling the ship. Then, as the paddle begins to rotate upward, the horizontal component of the paddle velocity diminishes. Before the paddle can rise out of the water, the horizontal velocity of the water overtakes that of the paddle, again causing drag.

A way to virtually eliminate drag is to free the paddles to pivot in the direction of water flow. To assure that drag is minimized, the paddle should be free to orient itself in a fully horizontal position. When the water moves faster than the paddle, the paddle can swing to present only its edge surface area against the flow. The action of a given paddle during immersion depends on its location along its path. As the paddle enters the water, it pivots to ride along the water surface. As its horizontal velocity component becomes greater than that of the water, the force of the paddle against the water orients the paddle vertically to present its broad surface area. As the paddle starts to rise, and slows horizontally to less than the water velocity, the water pivots the paddle to allow the water to travel freely beneath the upturned paddle. As the paddle leaves the water, it is reoriented vertically by gravity.

The sun gear 22 is free to rotate about its axis. As discussed above, arcuate slots 90 are provided in the bushing 27 between each planet gear and the shaft 43. See FIG. 8. Slots 90 are preferably a one quarter radial section, equivalent to ninety degrees of the circumference. The bushing 27 is rotatably mounted on shaft 43, while the planet gear is affixed to bushing 27. A rib 85 extends from the surface of the shaft into each slot 90 in the bushing 27. The paddle is free to pivot in a given direction along with the shaft until the ribs 85 abut against bushing 27. The abutment of ribs 85 against bushing 27 stop further rotation in a given direction. Then the paddle can pivot in the opposite direction until the ribs 85 abut once again against bushing 27. Roller bearings 19 surround bushing 27, and a holder sleeve portion 15 fits within gear 29 and surrounds bearing 19.

Since the slots 90 represent one circumferential quarter of the bushing 27, the full paddle pivot is ninety degrees. The ribs 85 and slots 90 are positioned so that the paddle is vertical at one extreme of its free pivot range and horizontal at the other. This permits the paddle to remain fixed against rotation in one direction to drive against the water and to pivot up in the other direction when the horizontal velocity of the water overtakes that of the paddle. Thus the full drive portion of the stroke is retained while the drag portion is virtually eliminated. An important added benefit of the free pivoting is that the ship can coast with the engine stopped and the paddles will not drag, for the reasons set forth above.

The free pivot direction must be reversed if the engine and apparatus 10 are to drive the ship in reverse. For this purpose, a lever 120 is attached with bolts 121 to central hub 21 to which sun gear 22 is attached. See FIG. 1. Lever 120 is rotatable between two fixed stops 130 over a range of ninety degrees. A ninety degree rotation of the sun gear 22 rotates each planet gear by ninety degrees, reorienting the slots 90 in the bushing 27 by ninety degrees. The new position of the slots 90 permit each paddle to pivot from a vertically downward position to a horizontal position opposite its original pivot direction. The paddles are thereby fixed against rotation in the direction opposite the reversed water flow and so can drive the ship in the reverse direction. The paddles are free to pivot in the reversed direction of water flow to prevent drag.

The apparatus 10 can also serve as a braking device to help stop the ship. A brace or powered arm may be attached to the lever 120 to rotate the sun gear 22 to stop the paddle movement. In this instance, drag is desired and the stopped paddles provide the drag. When the vessel is a small boat, the lever 120 may be pulled by hand to create the braking action.

It is understood that the above embodiment is contemplated to find application other than on boats and ships. For example, the same apparatus 10 with the free pivot feature may serve as a turbine rotated by a flowing body of water such as a river or a canal, or by the action of a pressurized steam or air upon it.

I claim:

1. A paddlewheel apparatus comprising:

a fixed support located on a predetermined axis;

a sun gear supported from said support on said axis;

a holder rotatable on said axis and extending around said sun gear;

a drive member drivably connected to said holder and rotatable in unison with said holder;

a set of additional gears forming an epicyclic gear train with said sun gear and rotatably mounted within said holder, said set of additional gears comprising planet gears spaced apart circumferentially around said sun gear;

a plurality of cantilevered paddles located adjacent to said holder, each said paddle comprising a free end and a supported end, and each being coupled at its supported end to a corresponding planet gear of said epicyclic gear train, each of said paddles hanging down substantially vertically and being unobstructed adjacent to said holder in all rotational positions of said holder;

and a lost-motion coupling between each of said paddles and said corresponding planet gear at its supported end, said lost-motion coupling permitting rotational lost-motion between each said paddle and said corresponding planet gear.

2. A paddlewheel apparatus according to claim 1 wherein said epicyclic gear train includes a plurality of idler gears, each in toothed engagement with the sun gear and a corresponding planet gear.

3. A paddlewheel apparatus according to claim 2 and further comprising:

a housing having opposite, substantially vertical, first and second end walls located laterally outward from said holder, and an upper peripheral wall extending between said end walls around said holder and said paddles, said housing being open at the bottom below said upper peripheral wall to pass said paddles.

4. A paddlewheel apparatus according to claim 3 and further comprising:

a central hub rotatably mounted in said fixed support and extending therefrom into said holder;

said sun gear being secured to said central hub.

5. A paddlewheel apparatus according to claim 3 and further comprising:

a central shaft rigidly connected to said holder for rotation in unison therewith and extending from said holder to said support;

anti-friction bearing means rotatably supporting said central shaft on said support;

said drive member being affixed to said central shaft outside said housing;

a central hub rotatably mounted in said fixed support and extending therefrom into said holder;

fastener means attaching said sun gear to said central hub.

6. A paddlewheel apparatus according to claim 1 and further comprising:

a housing surrounding said holder and said paddles except from below, said housing being open at the bottom to pass said paddles.

7. A paddlewheel apparatus according to claim 1 and further comprising:

a central hub rotatably mounted in said fixed support and extending therefrom into said holder;

said sun gear being secured to said central hub.

8. A paddlewheel apparatus according to claim 1 and further comprising:

a central shaft rigidly connected to said holder for rotation in unison therewith and extending from said holder to said support;

anti-friction bearing means rotatably supporting said central shaft on said support;

a central hub rotatably mounted in said fixed support and extending therefrom into said holder;

fastener means attaching said sun gear to said central hub.

9. A paddlewheel apparatus according to claim 1, wherein each said planet gear has an axial bore with a cylindrical wall and each paddle connected to a given planet gear has axle means with two ends, one of the two ends extending into said bore and having a rib means extending radially outward from said end, and each planet gear having an internal bushing with a radial indentation, with two radial walls, into which the rib means extends, such that the axle means and paddle are free to rotate within the given planet gear over the range permitted by the radial indentation until the rib means abuts either radial wall.

10. A paddlewheel apparatus according to claim 9, wherein said sun gear is free to rotate on said axis, additionally comprising lever means drivably connected to said sun gear for rotating said sun gear about its axis to alter the positions of said radial indentations of said bushings.

11. A paddlewheel apparatus according to claim 10, additionally comprising powered drive means for rotating said lever means.

12. A paddlewheel apparatus according to claim 1, wherein each said planet gear has an axial bore, said axial bore containing a bushing having a bore with a cylindrical wall and rib means extending radially inward from said cylindrical wall, and each paddle connected to a given planet gear has axle means with two ends, one of said two ends extending into said bore of said bushing, and said axle means having a radial indentation, with two radial walls, into which said rib means extends, such that said axle means and paddle are free to rotate within the given planet gear over the range permitted by said radial indentation until said rib means abuts either radial wall.

13. A paddlewheel apparatus comprising:

a holder on a predetermined axis and a support member rotatably supporting said holder for rotation on said axis;

an epicyclic gear train in said holder comprising a sun gear coaxial with said axis and a plurality of planet gears and idler gears spaced apart circumferentially around said sun gear, said planet gears and idler gears being rotatably mounted in said holder;

a plurality of paddles respectively coupled at one end to said planet gears and extending substantially vertically down from said planet gears, said paddles projecting horizontally from said holder in the manner of a cantilever and being substantially unobstructed in all rotational positions;

and a lost-motion coupling between each of said paddles and said planet gear at said one end, said lost-motion coupling permitting rotational lost-motion between each said paddle and said planet gear.

14. A paddlewheel apparatus comprising:

a fixed support located on a predetermined axis;

a sun gear supported from said support on said axis;

a holder rotatable on said axis and extending around said sun gear;

a drive member drivably connected to said holder and rotatable in unison with said holder;

a set of additional gears forming an epicyclic gear train with said sun gear and rotatably mounted within said holder, said set of additional gears comprising planet gears spaced apart circumferentially around said sun gear;

and a plurality of cantilevered paddles located adjacent to said holder, each said paddle comprising a free end and a supported end, and each being coupled at its supported end to a corresponding planet gear of said epicyclic gear train, each of said paddles hanging down substantially vertically and being unobstructed adjacent to said holder in all rotational positions of said holder, wherein each said planet gear has an axial bore with a cylindrical wall and each paddle connected to a given planet gear has axle means with two ends, one of the two ends extending into said bore and comprising a rib means extending radially outward from said end, and each planet gear comprising an internal bushing with a radial indentation, with two radial walls, into which the rib means extends, such that the axle means and paddle are free to rotate within the given planet gear over the range permitted by the radial indentation until the rib means abuts either radial wall.

15. A paddlewheel apparatus according to claim 14, wherein said sun gear is free to rotate on said axis, additionally comprising lever means drivably connected to said sun gear for rotating said sun gear about its axis to alter the positions of said radial indentations of said bushings.

16. A paddlewheel apparatus according to claim 15, additionally comprising powered drive means for rotating said lever means.

* * * * *